US006749689B2

(12) United States Patent
Greene et al.

(10) Patent No.: US 6,749,689 B2
(45) Date of Patent: Jun. 15, 2004

(54) CONTROLLED RECIPROCATING MACHINE AND METHOD

(75) Inventors: Charles A. Greene, Elyria, OH (US); Larry S. Phillips, Brookpark, OH (US)

(73) Assignee: Advanced Robotic Technologies, Cleveland, OH (US)

( * ) Notice: Subject to any disclaimer, the term of this patent is extended or adjusted under 35 U.S.C. 154(b) by 23 days.

(21) Appl. No.: 10/135,806

(22) Filed: Apr. 30, 2002

(65) Prior Publication Data

US 2003/0201338 A1 Oct. 30, 2003

(51) Int. Cl.[7] ..... B05B 3/00; B05C 11/00
(52) U.S. Cl. ..... 118/695; 118/323; 118/697
(58) Field of Search ..... 118/695, 696, 118/697, 698, 702, 706, 323, 313, 314, 676, 679, 680; 239/225.1

(56) References Cited

U.S. PATENT DOCUMENTS 4,278,046 A * 7/1981 Clarke et al. ..... 118/695
4,447,007 A * 5/1984 Farines ..... 239/165
4,762,013 A * 8/1988 Peter et al. ..... 118/323
5,372,856 A * 12/1994 Ogasawara ..... 118/323
5,814,375 A * 9/1998 Hissen ..... 118/323

* cited by examiner

*Primary Examiner*—Richard Crispino
*Assistant Examiner*—Yewebder Tadese
(74) *Attorney, Agent, or Firm*—Renner, Otto, Boisselle & Sklar, LLP

(57) ABSTRACT

A reciprocating coating system for coating objects. The reciprocating coating system includes a computer controller for controlling the motion of a coating device, and to allow configuration of system parameters. Configurable parameters include stroke length, stroke center point and stroke speed.

4 Claims, 5 Drawing Sheets

CONTROLLED RECIPROCATING MACHINE AND METHOD

FIELD OF THE INVENTION

The present invention relates to the field of industrial painting and coating. More particularly, the invention relates to a method and system for controlling a reciprocating coating apparatus.

BACKGROUND OF THE INVENTION

Reciprocating coating machines have been in wide use in the coating industry for a number of years. In general, a reciprocating coating machine has at least one arm and at least one applicator, one example being known as a paint spray gun, attached to the arm. The arm travels in a linear path (e.g. left/right, up/down, etc.) and typically is actuated by a motor-cam assembly or a pneumatic system. As the arm is in motion, the applicator is energized by a solenoid or equivalent device, and the applicator emits a mist of paint or other coating material. The area coated by the reciprocating coating machine is determined by the stroke of the arm and the width of the mist. An object, such as a tool or a machine part, is placed on a conveyor system and passes by the reciprocating coating machine. As the object travels past the machine, it passes through the mist and thus is covered by a coat of paint.

Since the range of arm motion in a reciprocating coating machine is typically designed to cover various part sizes, early reciprocating coating machines tended to be very inefficient. This was due to the fact that on early machines, the arm stroke was generally not adjustable. Thus, for example, if the part size encompassed the entire stroke of the arm, the coating application was fairly efficient. If, however, the part size was significantly less than the stroke of the arm, a significant amount of coating was wasted as the arm traveled through an area that did not require a coating (a dead zone). Furthermore, the excess stroke introduced a delay as the arm traveled through the "dead zone" and thus reduced the maximum speed the part could travel past the coating arm. Moving the part too fast could result in the part leaving the reach of the applicator, resulting in an uneven coating application or possibly uncoated portions of the part.

Attempts have been made to increase the efficiency of the reciprocating coating machine, and in particular, to reduce the waste of the coating material. One issue which has been addressed is the stroke of the coating arm. As discussed above, if the part size is significantly less than the stroke of the arm, a significant amount of coating is wasted. To solve this problem, adjustable cams were installed to allow the stroke to be altered. To change the stroke, the cam would be changed to meet the requirements of the part. Another solution was to use pneumatics to control the stroke. Pneumatic switches were placed at the desired upper and lower stroke points and when the arm triggered these switches, the air flow was reversed and the coating arm would change direction.

While these approaches address the problem of coating waste due to excessive stroke, they have their limitations and drawbacks. For example, it is impractical to have a cam on hand for every conceivable stroke length. Therefore, a cam is used that places the stroke length in the "ball park" for a particular part. Thus, while the stroke length may be reduced by the selected cam to more closely match the respective part, there is room for further improvement. Furthermore, the shape of the cam inherently has an arc in its swing, especially at the location at which the coating arm changes direction. Therefore, the motion of the coating arm is non-linear or of non-uniform speed, especially at the extreme stroke points. Yet another drawback of a cam-driven coating arm is that the center point of the stroke is difficult to change; additional cams are required to alter the center point of the stroke.

As mentioned above, pneumatic driven reciprocating coating machines employ pneumatic switches to set the arm upper and lower stroke travel. Thus, while the switches provide operator control of the stroke length, they must be set each time a new stroke length is desired. Once set, the switch positions need to be verified, and more often than not, re-adjusted until the desired travel is achieved.

Furthermore, changing the stroke on both the cam and pneumatic driven reciprocating coating machine requires that the production line, for example, be shut down while the adjustment is made. This results in significant down time and lost production. Another drawback is that the stroke length may not be changed dynamically e.g. "on the fly", to match the contour of a part passing by the coating arm.

Accordingly, it would be advantageous to facilitate adjusting the stroke length of a reciprocating coating arm. Additionally, It would be advantageous to facilitate adjusting the stroke center point of a reciprocating coating arm. It also would be advantageous to facilitate adjusting the stroke speed of a reciprocating coating arm.

SUMMARY OF THE INVENTION

In the light of the foregoing, one aspect of the invention relates to a coating system, which includes a coating applicator, a movable arm for moving the coating applicator to carry out a coating operation, and a dynamic controller for determining at least one of stroke length, stroke center point, and stroke speed.

A second aspect of the invention relates to a coating system, which includes a movable arm and at least one coating applicator coupled with respect to the movable arm. A first actuator provides motion to the movable arm, the first actuator being controlled by a computer controller. The computer controller includes a processor, and the computer controller is operatively coupled to the first actuator. A first data representing at least one of stroke length, stroke center point, and stroke speed of the movable arm is used in a computer program. The computer program is executed by the processor to cause the computer controller to dynamically command the first actuator to change at least one of stroke length, stroke center point, and stroke speed of the movable arm based on the first data.

A third aspect of the invention is a method for controlling a movable arm of a coating device. The method includes the steps of entering a first data into a computer controller, the first data representing at least one of stroke length, stroke center point, and stroke speed of the movable arm. A motion profile is generated based on the first data, and a position feedback indicative of the position of the movable arm is provided. A torque reference is produced based on the motion profile and the position of the movable arm, and is sent to an actuator to provide motion to the movable arm. The torque reference is regulated to dynamically move the movable arm to change at least one of stroke length, stroke center point, and stroke speed of the movable arm based on the first data.

Other aspects, features, and advantages of the invention will become apparent from the following detailed description. It should be understood, however, that the detailed description and specific examples, while indicating several preferred embodiments of the present invention, are given by way of illustration only and various modifications may naturally be performed without deviating from the present invention.

DETAILED DESCRIPTION OF THE INVENTION

Figure 1:
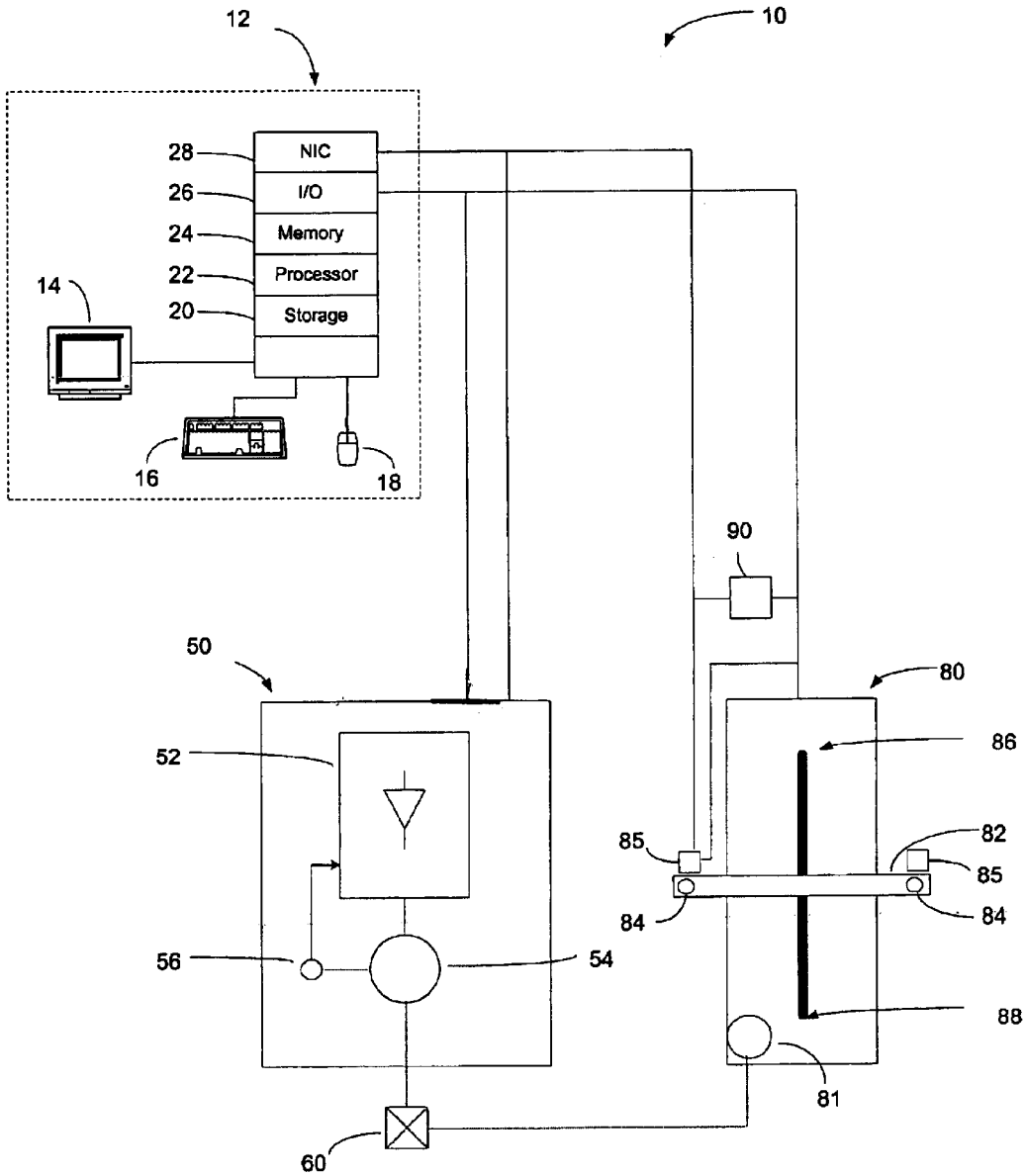
FIG. 1 is an environmental view of a coating system in accordance with the present invention.

The following is a detailed description of the present invention with reference to the attached drawings, wherein like reference numerals will refer to like elements throughout.

Referring now to FIG. 1, an overview of a coating system 10 embodying the present invention is shown. The coating system 10 may be used to apply a coating in various applications, such as a painting system, an adhesive applicator, a fiberglass coater, etc. The coating system 10 includes a computer controller 12 for entry, display and control of system parameters, such as stroke length, stroke center point, stroke speed, or any other process related variable. Typically, the computer controller 12 is based on an industrial workstation. As is well known by those skilled in the art, an industrial workstation is a computer designed to withstand the harsh environments found in industrial applications. A non-industrial workstation (e.g. standard personal computer) may be used, however, if sufficient protection from the industrial environment is provided. Other dynamic controllers also or alternatively may be used. A dynamic controller as referred to herein may be any controller which has the ability to dynamically change the operating parameters of the coating system 10 without the need to stop or shut down the coating operation, e.g. the ability make operational changes "on the fly".

The computer controller 12 includes a display 14 for viewing system information. The technology used in the display is not critical and may be any type currently available, such as a flat panel liquid crystal display (LCD) or a cathode ray tube (CRT) display, or any display subsequently developed. A keyboard 16 and pointing device 18 may be used for data entry, data display, screen navigation, etc. The keyboard 16 and pointing device 18 may be separate from the computer controller 12 or they may be integral to it. A computer mouse or other device that points to or otherwise identifies a location, action, etc., e.g. by a point and click method or some other method, are examples of a pointing device. Alternatively, a touch screen (not shown) may be used in place of the keyboard 16 and pointing device 18. A touch screen is well known by those skilled in the art and will not be described in detail herein. Briefly, a touch screen implements a thin transparent membrane over the viewing area of the display 14. Touching the viewing area sends a signal to the computer controller 12 indicative of the location touched on the screen. The computer controller 12 may equate the signal in a manner equivalent to a pointing device and act accordingly. For example, an object on the display 14 may be designated in software as having a particular function (e.g. view a different screen). Touching the object may have the same effect as directing the pointing device 18 over the object and selecting the object with the pointing device, e.g. by clicking a mouse. Touch screens may be beneficial when the available space for a keyboard 16 and/or a pointing device 18 is limited.

Included in the computer controller 12 is a storage medium 20 for storing information, such as application data, screen information, programs, etc. The storage medium 20 may be permanently fixed within the computer controller 12 or it may be removable. A processor 22 combined with a memory 24 and the storage medium 20 execute programs to perform various functions, such as position control, screen display, system setup, etc.

The computer controller 12 may also include I/O (input/output) points 26 to provide digital and analog I/O capabilities. The I/O points 26 may be used to send and receive feedback signals from various devices in the system. For example, a digital output signal may be used to initiate a spray command to a spray valve solenoid, and a digital input may be used to receive confirmation that the spray valve has opened. In a similar fashion, an analog output may be used to transmit a 4–20 mA air pressure reference to a control valve, while an analog input is used to receive a 4–20 mA pressure feedback signal from a pressure sensor. Alternatively the analog signals may be voltage signals, such as a 0–10 VDC signal. These signal formats are, of course, exemplary and it will be appreciated that others may be used.

A network interface card (NIC) 28 allows the computer controller 12 to communicate with several components within the coating system 10. The type of NIC 28 used may depend on the communication protocols available on other components present within the coating system 10. For example, an actuator 50 (described below) may not have Ethernet capabilities, thus suggesting that an Ethernet NIC is not the best choice. Multiple NIC's 28, however, may be used to construct a network to meet the needs of the individual components. Many electronic devices, such as sensors, actuators, etc. have network capabilities built in to them and thus it is possible to construct a coating system 10 wherein a majority, if not all of the devices, can communicate with the computer controller 12 via the NIC 28. While the NIC 28 provides an easy and quick method to communicate with devices in the coating system 10, it is noted that the NIC 28 is optional and the system may be constructed without a NIC 28. For example, the coating system 10 may use only analog and digital I/O to control the system, without direct communications to any device.

The actuator 50 provides motion to the system and may be driven by hydraulic, pneumatic and/or electrical power. For exemplary purposes, the actuator 50 discussed herein is an electrical drive system, and specifically is a servo system. Alternate electrical configurations, however, may be implemented. For example, a closed loop AC vector drive system or a closed loop DC drive system each may provide satisfactory results. The actuator 50 includes a servo amplifier 52 for providing current to a servo motor 54. A feedback device 56 provides speed and/or position feedback of the servo motor shaft (not shown). The servo motor shaft is coupled to a gearbox 60, to provide torque multiplication, if necessary. Control of the actuator 50 is performed by a control loop implemented in software, as is illustrated in FIG. 2, for example.

The servo motor shaft (not shown) is mechanically coupled to the reciprocating unit 80 through the gearbox 60 and a coupling 81. Alternatively, the gearbox 60 may be eliminated if it is not needed to meet the requirements of the system. The coupling 81 drives a movable arm 82 within the reciprocating unit 80. The movable arm travels in a linear motion, typically in a vertical up/down direction. A horizontal left/right motion or diagonal derivative, however, may be employed if required. An applicator 84, such as a paint spray gun, a paint bell, a powder gun, an adhesive applicator, etc., is attached to the movable arm 82 and an applicator actuator 85, such as a solenoid, enables and disables the applicator 84. The movable arm 82 has an upper stroke limit 86 and a lower stroke limit 88. A sensor or senors 90, such as a photo eye, proximity switch, video camera, etc. may be used to detect the type of part before the movable arm 82.

Figure 2:
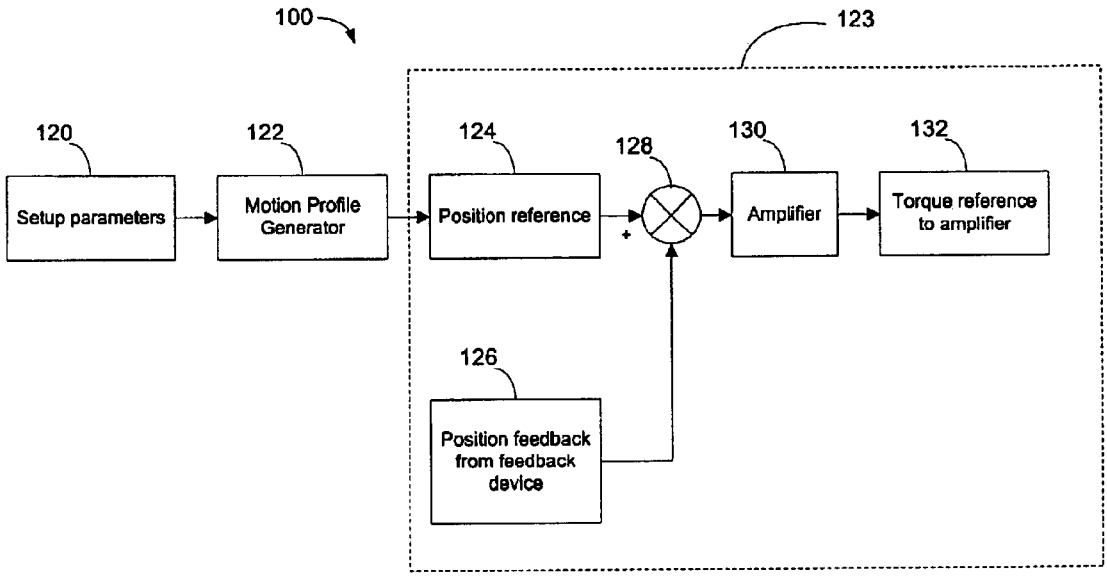
FIG. 2 is a simplified block diagram of a control loop employed in the invention.

Referring to FIG. 2, a simplified block diagram of a control loop 100 is illustrated. Control of the actuator 50 begins with the entry of the setup parameters at step 120. Setup parameters will be discussed in more detail later. Once the setup parameters are entered, they are routed to a motion profile generator as seen at step 122. The motion profile generator creates the position reference for the position control loop 123. In turn, the position control loop 123 generates a torque reference signal for the actuator 50. Position control loops are well known by those skilled in the art and will not be discussed in detail. Briefly, a position reference signal 124 and a position feedback signal 126 are brought together in a summing junction 128. The difference between the two signals is the position error, which is fed to an amplifier 130. The amplifier may be a simple proportional only controller (P), a proportional plus integral controller (PI), or a proportional plus integral plus derivative controller (PID). The output of the amplifier is the torque reference signal.

The torque reference signal, along with a run command, is sent through the NIC 28, the I/O points 26, or through a combination of both, to the servo amplifier 52. When the run command is received by the servo amplifier 52, the servo amplifier is enabled and it begins to supply current to the servo motor 54 in proportion to the torque signal from the computer controller 12, thus causing the servo motor 54 to rotate. A feedback device 56, such as a resolver or an encoder, may provide speed and/or position feedback of the motor shaft (not shown). The control loop 100 will output a torque signal to the actuator 50 until the motion profile created by the motion profile generator, e.g. position reference, is satisfied, as determined from the feedback device 56.

While a pure position control loop is illustrated in FIG. 2, it will be appreciated by those skilled in the art that alternate control schemes may be employed. For example, the position control loop may serially feed a speed loop (not shown), the speed loop generating the torque reference for the actuator 50. Alternatively, the position loop may feed a speed loop in a parallel scheme, wherein the position loop controls the upper and lower torque limit of the speed loop, and the speed loop is driven into saturation with a slight speed offset.

Figure 3A:
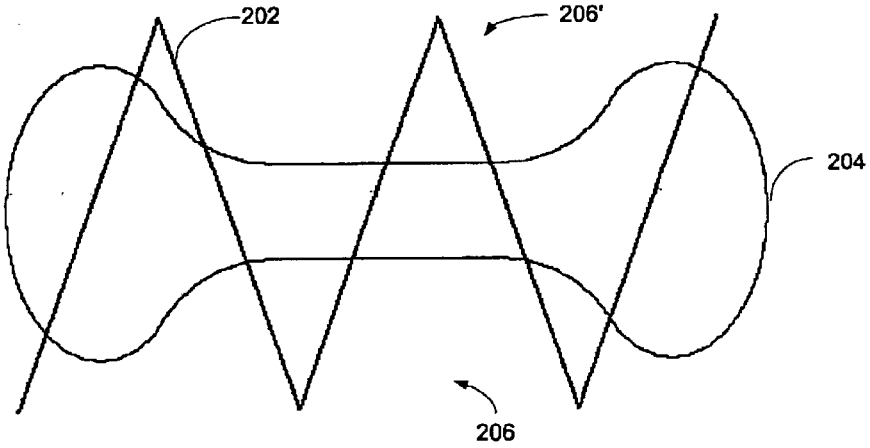
FIG. 3A illustrates the spray path of a fixed stroke length prior art coating system.

Referring to FIG. 3A, the coating path of a prior art coater is illustrated. The saw-tooth pattern 202 illustrates the coating path of the movable arm 82 as a bone shape part 204 passes through the coating spray. As can be seen, there is significant coating and motion covering an area 206 and 206' that is not occupied by the object. This results in coating waste and reduced throughput, as the system requires the object to pass by at a speed sufficient to evenly coat the entire part 204. Due to the excess motion, the speed may not be optimal.

The coating system 10 may be configured to dynamically change the stroke length of the movable arm 82 quickly, easily and without disturbance to production. This is accomplished by entering the desired stroke length into the computer controller 12. In altering the stroke length, there is no need to stop the production line to change components or reset switches. For example, if the stroke length were currently at 24 inches, and it is desired to change the stroke length to 12 inches, an operator may enter the new length directly into the computer controller 12. The entry may be in engineering units or any other units that are meaningful to the process. The data is entered into the computer controller 12 using the keyboard 16 and/or the pointing device 18. Alternatively, and as described previously, the data may be entered using a touch screen interface (not shown) or by some other device. Once entered, the data is automatically routed to the software control loop 100, which generates a torque reference for the actuator 50. The torque reference is transmitted to the actuator 50 through the NIC 28, or alternatively through the I/O points 26. In turn, the actuator 50 develops a torque which is transmitted to the reciprocating unit coupling 81 directly or through an optional gearbox 60. The reciprocating unit coupling 81 is mechanically coupled to the movable arm 82, and thus by controlling the actuator 50, control of the movable arm stroke is achieved.

In a similar manner, the stroke center point and/or stroke speed also may be modified. For example, instead of changing the stroke length, it may be desired to change the stroke center point, the stroke speed, or a combination of all three. The procedure for accomplishing the change is similar to the procedure for changing the stroke length detailed above, except that instead of entering the stroke length into the computer controller 12, the operator would enter the stroke center point and/or the stroke speed.

Coating waste may be reduced further by controlling the applicator 84 based on the position of the movable arm 82. For example, if the object being coated has an open portion (e.g. a donut), coating waste can be reduced by disabling the applicator 84 as it passes through the open portion of the object. Since the position of the movable arm is known, the applicator can be enabled/disabled based on the position of the movable arm 82. Position references may be entered into the computer controller 12 indicating at which position of the movable arm 82 the applicator actuator 85 should be enabled or disabled. Control of the applicator 84 is achieved through the applicator actuator 85. By communicating with the applicator actuator 85 via the NIC 28 and/or the I/O points 26, the applicator actuator 85, and thus the applicator 84, can be enabled or disabled dynamically anywhere along the path of the movable arm 82.

In another embodiment of the present invention, the coating system 10 may detect the object type to be coated and automatically change the stroke length, stroke center point and/or stroke speed based on predefined parameters. Sensors 90, such as a photo eye, a proximity switch, a video camera, etc., may be installed on the coating system 10 to detect the presence of the object. The sensors 90 may communicate with the computer controller 12 via the NIC 28 and/or the I/O points 26. Based on the information received from the sensors 90 , the computer controller 12 may determine which object is present and access the data associated with that particular object. For example, two parts may be run on the coating system 10. The first part (part A) requires the movable arm 82 to move through a stroke of 12 inches and the second part (part B) requires the movable arm 82 to move through a stroke of 24 inches. A photo eye may be set to trigger (e.g. logic 1) on the presence of part A, but not on the presence of part B. During run time, the computer controller 12 monitors the data from the photo eye. If the photo eye is triggered, e.g. logic 1, the computer controller 12 determines that the object is part A and accesses the data corresponding to part A, which in the present example is a stroke length of 12 inches. Conversely, if the photo eye is not triggered, e.g. logic 0, the computer controller 12 accesses the data corresponding to part B, which is a stroke length of 24 inches. It is noted that the preceding illustration is exemplary and is not limited to the detection of only two objects, but includes the detection of and corresponding adjustment to the movable arm 82 for any number of objects.

In another embodiment, the coating system 10 may change the stroke length dynamically based on the number of strokes desired at each stroke length. For example, the coating system 10 may perform X number of strokes at 24 inches and then perform Y number of strokes at 12 inches. This can be achieved by including a stroke cycle with the stroke length. For example, after the stroke length is entered, the computer controller 12 may prompt the operator for the number of stroke cycles to perform at the particular stroke length. If the operator enters a stroke length of 24 inches and then a cycle of 5, and then enters a stroke length of 12 inches and a cycle of 3, the movable arm 82 will perform 5 strokes at 24 inches and then 3 strokes at 12 inches. A cycle of 0 may indicate to the computer controller 12 that the entered stroke length is to be executed continuously.

Figure 3B:
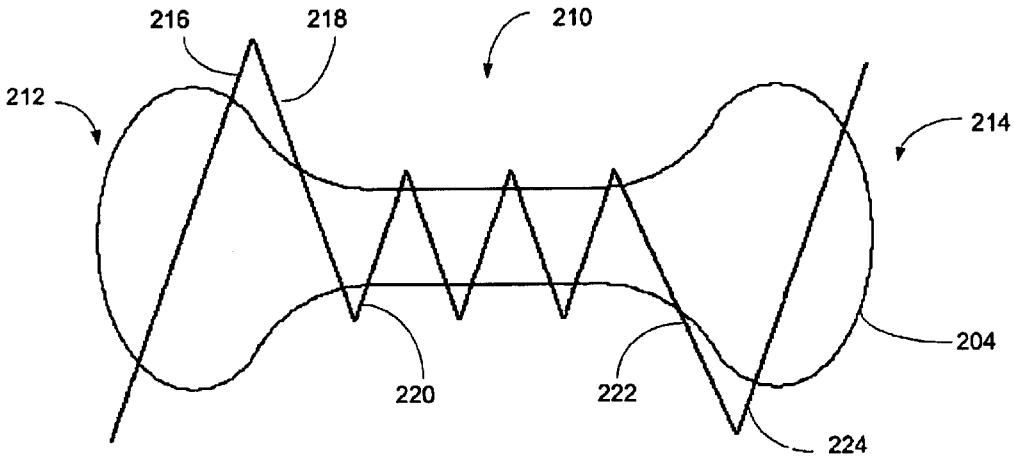
FIG. 3B illustrates an exemplary spray path of a variable stroke length coating system in accordance with the present invention.

Referring to FIG. 3B, an exemplary configuration is shown for the bone shape object 204. It is noted that in the following illustration the variables Z, Z' and Z" represent different stroke lengths. The bone shape object 204 has a center portion 210 and two end portions 212, 214. As can be seen in FIG. 3B, the center portion 210 is thinner than the two end portions 212, 214. In configuring the coating system 10, a first entry 216 and second entry 218 may be set for a stroke length of Z and Z' respectively. Both entries 216 and 218 may be set for a cycle of 1. The third entry 220 may be set for a stroke length of Z" and a cycle of 5. The fourth entry 222 and fifth entry 224 may be set for a stroke length of Z' and Z respectively. Both entries 222 and 224 may be set for a cycle of 1. As can be seen in FIG. 3B, using this configuration the movable arm 82 tracks the contour of the bone shape object 204, thus reducing coating waste and motion. It is noted that the illustration of a bone shape object is merely exemplary and it is not intended to limit the scope of the invention in any way.

Figure 3C:
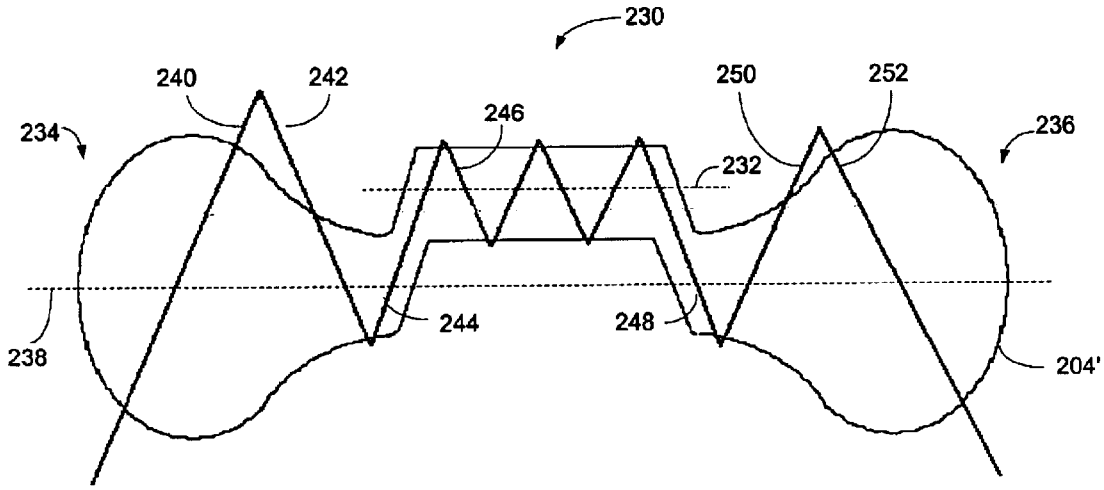
FIG. 3C Illustrates an exemplary spray path of a variable stroke length and variable stroke center point coating system in accordance with the present invention.

The stroke center point and/or stroke speed also may be changed dynamically. For example, if the center portion of the object to be coated has a center line different than the center line of the overall object, both the stroke length and the stroke center point may be altered to accommodate the object. Referring to FIG. 3C, the bone shape object 204' has a center portion 230, which has a centerline 232. The two end portions 234 and 236 each have a centerline 238, which is different from the centerline 232. To coat the bone shape object 204' in an efficient manner, the coating system 10 may be configured to alter the stroke length and the center point. It is noted that in the following illustration the variables Z, Z' and Z" and Z'" represent different stroke lengths, and X and X' represent different center points. For example, data may be entered into the coating system 10 in the following manner. The first entry 240, second entry 242 and third entry 244 may have a stroke length of Z, Z' and Z" respectively. All three may have a center point of X and a cycle of 1. The fourth entry 246 may have a stroke length of Z'", a center point of X' and a cycle of 4. The fifth entry 248, sixth entry 250, and seventh entry 252 may have a stroke length of Z", Z' and Z respectively. All three may have a center point of X and a cycle of 1. As is shown in FIG. 3C, the movable arm follows the contour of the object 204'. At stroke entry 246, the center point of the stroke is changed to follow the center line 232 the center portion 230. At stroke entry 248, the center point of the stroke is changed to follow the center line 238 of the end portions 234 and 236.

Figure 4A:
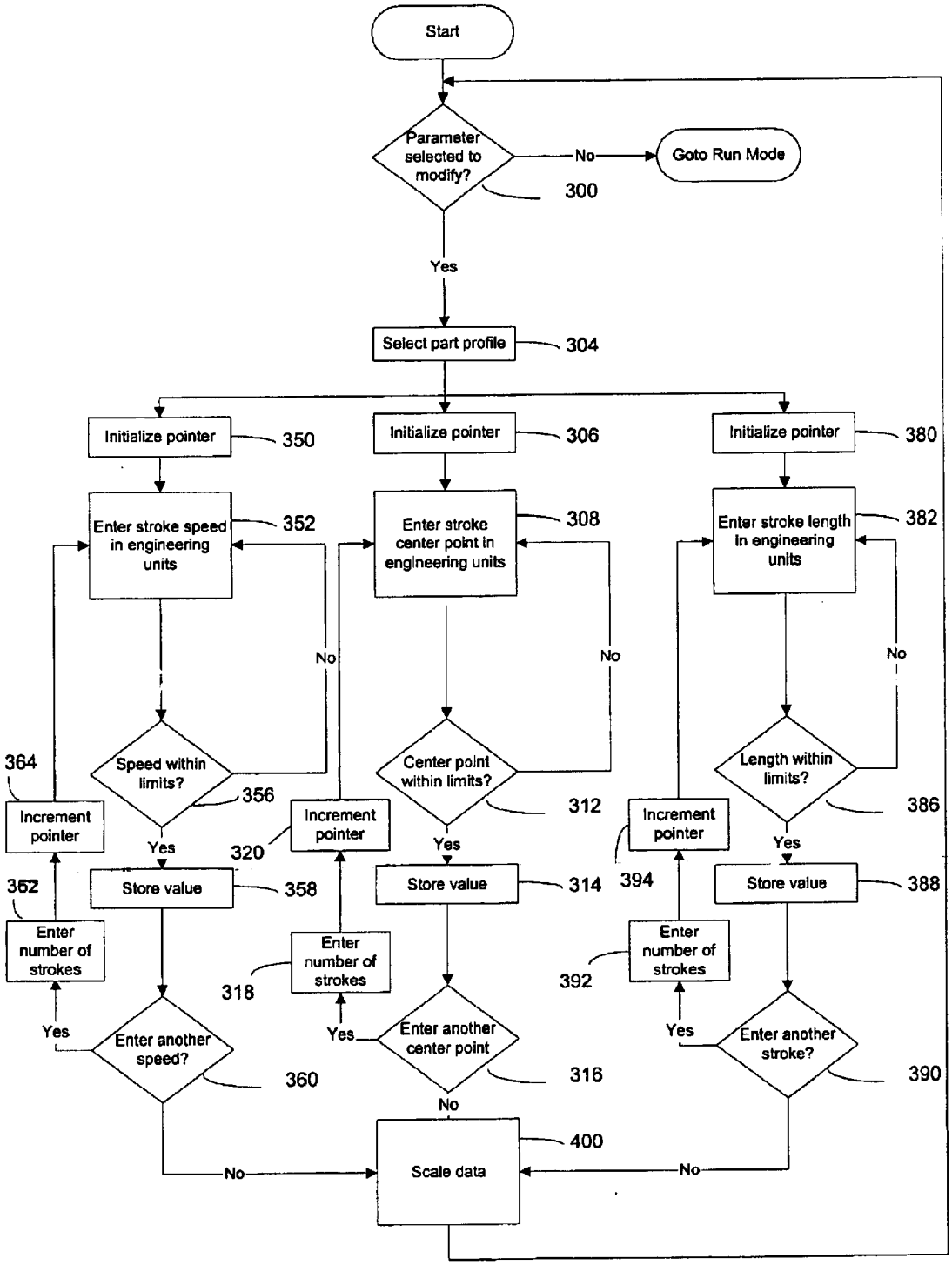
FIG. 4A is a block diagram illustrating an exemplary setup procedure or method of a coating system in accordance with the present invention.
Figure 4B:
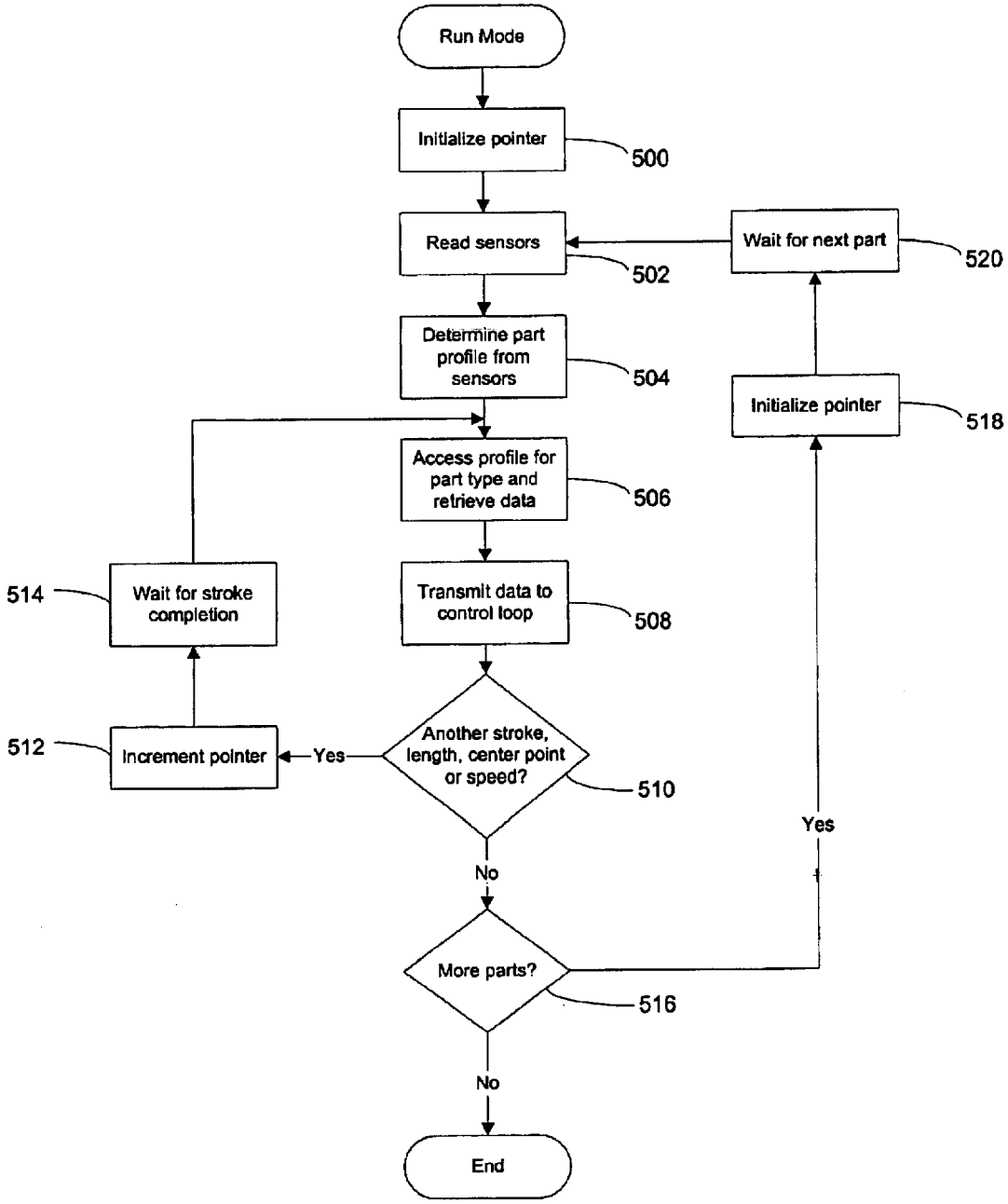
FIG. 4B is a block diagram illustrating an exemplary the run time procedure or method of operation of a coating system in accordance with the present invention.

Referring now to FIG. 4A and FIG. 4B, flow diagrams illustrating the above steps are shown. Beginning at step 300 of FIG. 4A, the processor 22 checks to determine if a parameter is being modified. Parameter modification may be indicated by the operator selecting a parameter on the display 14 using the keyboard, 16, pointing device 18, or the touch screen (not shown). If no modification is requested, then the processor 22 bypasses the parameter modification routine and continues with normal run mode at step 500 of FIG. 4B. If modification is requested, then the processor 22 prompts the operator, via the display 14, for example, to select a part profile as shown at step 304. The part profile is the ID number given to each individual part and it is used for managing data associated with that part. For example, if multiple parts will be run on the coating system 10, then the data corresponding to each part may be entered to allow the coating system 10 to dynamically change the system parameters to match each part as it appears before the applicator 84. The first part may be given an ID number of 1, and all data corresponding to this part will be stored using the ID number 1. A second part may be given an ID number of 2, and all data corresponding to this part will be stored using the ID number of 2. It is noted that if dynamic parameter modification is not desired, step 304 may be eliminated.

Next, depending on which parameter is selected at step 300, the processor 22 branches off to the respective parameter. Assuming that the stroke center point is selected, the processor 22 progresses to step 306, where a pointer is initialized. The pointer is used to index into an array, as will be discussed shortly. At step 308, the stroke center point is entered by the operator in the required units using the keyboard 16, the pointing device 18, or the touch screen (not shown) as detailed previously. The center point may be entered numerically, e.g. typing the value on the keyboard 16, or by expressing the center point graphically, e.g. using the pointing device 18 to select the center point on a graphical representation of the coating system 10 as shown on the display 14. The entered value is checked by the processor 22 to ensure that it is within an acceptable range at step 312. If the data is not within range, then the processor 22 returns to step 308 and the operator may reenter the data. If the value is within range, then the processor 22 stores the data at step 314. Data may be stored in a database, a multidimensional array, or any conventional method of storing data. For exemplary purposes, data storage will be discussed herein using a multidimensional array.

A multidimensional array will be referred to herein as X% [n][m], where X% is the array name and "%" signifies that the array is an integer. Array indices "n" and "m" may be any non-negative integer. The first index of the array (e.g. "n")

may be used to indicate the ID number, and the second index of the array (e.g. "m") may be used to indicate the data type (e.g. 1=stroke length, 2=stroke center point, 3=stoke speed, etc.). Then, for example, the array X% [1][2] contains data for part ID number 1, and the data is the stroke center point. Likewise, the array X% [2][1] contains data for part ID number 2, and the data pertains to the stroke length. For simplicity, the array is described herein as being two dimensional. Arrays greater than two dimensions, however, may be employed depending on the features present in the coating system 10 and the level of complexity. Furthermore, the use of an integer array is merely exemplary and other array types, e.g. a real number array, may be employed.

Cycle control is configured at step 316, wherein the operator indicates whether another center point is entered. As described previously, cycle control allows the specified parameter to be run for a specified number of strokes, after which a second data is executed for another specified number of strokes, and so on.

A stroke is defined herein as a single continuous motion from a starting point to an end point. For example, if the movable arm 82 is resting at the lower stroke limit 88 (FIG. 1) and it is moved to the upper stroke limit 86, then this is one stroke. Moving the movable arm 82 from the upper stroke limit 86 down to the lower stroke limit 88 (or any point in between) is stroke two. This is illustrated in FIG. 3B, wherein the first stroke is at length Z, stroke two is at length Z', strokes three through seven are at length Z", stroke eight is at length Z', and stroke nine is at length Z.

If cycle control is enabled, then the operator may be prompted to enter the number of strokes to be performed at the specified stroke center point, as indicated by step 318. This may be referred to herein as the number of cycles for the particular stroke. Next at step 320, a pointer (originally initialized at step 306) is incremented by the processor 22. The pointer is used to indicate the number of data points to cycle and provides a mechanism for storing and retrieving each respective center point from the array. Each additional cycle increments the pointer by one. Data storage may be in a single multidimensional array similar to the array discussed above, or multiple arrays may be used. Next the processor 22 moves back to step 308 and the operator enters another stroke center point and the process repeats until the operator indicates that no more points are to be entered. It is noted that steps 306, 316, 318 and 320 are optional and may be eliminated if cycle control is not desired.

When all stroke center points have been entered, the processor 22 scales the data at step 400 (if necessary). Next, the processor 22 moves back to step 300 to determine if further data will be entered. If not, then the processor 22 moves to step 500 of FIG. 4B.

It is noted that the process for setting the stroke speed and stroke length is similar to the process for setting the stroke center point. For example, stroke speed setup is detailed in steps 350–364, and stroke length setup is detailed in steps 380–394. Steps 350–364 and steps 380–394 duplicate the process described in steps 306–320 (stroke center point). Steps 350–364 (stroke speed) and steps 380–394 (stroke length) differ from steps 306–320 (stroke center point) in that all occurrences of stroke center point are replaced with stroke speed and stroke length respectively.

Moving now to FIG. 4B, the run mode diagram will be discussed. Beginning at step 500, the processor 22 initializes a pointer. The pointer is used to index the array to extract multiple stroke lengths, stroke speeds, or stroke center points (if enabled). This feature will be discussed in more detail below. Moving to step 502, the status of the sensor 90 is read by the processor 22 to determine the object type that is before the coating system 10. As was discussed previously, a photo eye, proximity switch, etc. may detect the presence of a particular object type and send a signal to the computer controller 12 indicative of the object type detected. The signal may be transmitted over the NIC 28 or through the I/O points 26. The information from the sensor 90 is decoded by the processor 22 to determine the ID number used at step 504. Based on the ID number obtained, the processor 22 retrieves the object data relating to the particular object (e.g. stroke length, stroke center point, stroke speed) from the array using the ID number as index "n" of the array, as indicated by step 506. Once the data is retrieved, the information is sent to the control loop 100 as shown at step 508.

Next at step 510, the processor 22 determines whether cycle control is desired. As discussed previously, cycle control allows the coating system 10 to perform a particular stroke parameter for a set number of stroke cycles. If cycle control is enabled, then the pointer is incremented at step 512 and the processor 22 waits for the current stroke to complete at step 514. Once the stroke is complete, the processor 22 uses the incremented pointer and the array to retrieve the next piece of data for the particular ID number, the data is transmitted to the control loop 100, and the process is repeated. If cycle control is not enabled, then the processor 22 moves on to step 516 where it determines if more objects are to be coated. If no more objects are to be coated, then the sequence is complete. If more parts are to be coated, then the pointer is reinitialized by the processor 22 at step 518, and the processor 22 waits for the next part at step 520. Once the next part is present, the sensors 90 are read at step 502 and the process repeats until no more parts are top be coated.

While particular embodiments of the invention have been described in detail, it is understood that the invention is not limited correspondingly in scope, but includes all changes, modifications and equivalents coming within the spirit and terms of the claims appended hereto.

What is claimed is:

1. A coating system, comprising:

a movable arm;

at least one coating applicator coupled with respect to the movable arm;

a first actuator for providing motion to the movable arm;

a computer controller for controlling the first actuator, wherein the computer controller includes a processor, and the computer controller is operatively coupled to the first actuator;

a first data representing at least one of stroke length, stroke center point; and stroke speed of the movable arm;

a computer program executed by the processor to cause the computer controller to dynamically command the first actuator to change at least one of stroke length, stroke center point, and stroke speed of the movable arm based on the first data;

a second data representing a number of cycles of the movable arm, wherein the second data is associated with the first data; and a storage means for storing data, wherein the storage means accommodates multiple instances of the first data and the second data, and the computer program executed by the processor causes the computer controller to command the first actuator to sequentially change at least one of stroke length, stroke center point, and stroke speed of the movable arm upon the movable arm completing the number of cycles in the associated second data.

2. The coating system of claim 1, wherein the data in the storage means may be saved to a storage medium and recalled from the storage medium.

3. The coating system of claim 1, wherein the storage means is an array.

4. The coating system of claim 1, wherein the storage means is a database.

* * * * *